US009663120B2

(12) United States Patent
Vladimirovich et al.

(10) Patent No.: US 9,663,120 B2
(45) Date of Patent: May 30, 2017

(54) SIDE BEARERS IN A RAILCAR TRUCK

(71) Applicant: Rail 1520 IP Ltd., Limassol (CY)

(72) Inventors: Sukhykh Igor Vladimirovich, St. Petersburg (RU); Rudakova Ekaterina Alexandrovna, St. Petersburg (RU); Babanin Victor Sergeevich, St. Petersburg (RU)

(73) Assignee: Rail 1520 IP Ltd., Limassol (CY)

( * ) Notice: Subject to any disclaimer, the term of this patent is extended or adjusted under 35 U.S.C. 154(b) by 184 days.

(21) Appl. No.: 14/606,512

(22) Filed: Jan. 27, 2015

(65) Prior Publication Data

US 2016/0152249 A1 Jun. 2, 2016

(30) Foreign Application Priority Data

Dec. 1, 2014 (RU) ..... 2014148119

(51) Int. Cl.
*B61F 5/14* (2006.01)

(52) U.S. Cl.
CPC ..... *B61F 5/14* (2013.01)

(58) Field of Classification Search
CPC ..... B61F 5/00; B61F 5/02; B61F 5/04; B61F 5/06; B61F 5/08; B61F 5/14; B61F 5/22; B61F 5/24
See application file for complete search history.

(56) References Cited

U.S. PATENT DOCUMENTS 7,121,212 B2 * 10/2006 Schorr ..... B61F 5/14 105/199.3
2004/0187726 A1 9/2004 Schorr et al.
2013/0327246 A1 * 12/2013 Aspengren ..... B61F 5/142 105/199.3

FOREIGN PATENT DOCUMENTS

RU 2370388 10/2009

* cited by examiner

*Primary Examiner* — R. J. McCarry, Jr.
(74) *Attorney, Agent, or Firm* — Price Heneveld LLP

(57) ABSTRACT

A side bearer of a railcar truck is designed to limit reciprocal displacement of a truck and railcar under a frame. The side bearer includes a carrying body with a guiding opening wherein a bearing cup is mounted by applying a springing element. A thrust collar is implemented on a guiding wall in a groove. Upon off-loading the cup e.g., during dismantling of a truck from under a railcar, a thrust collar bears against a limiting face ensuring unreleasable connection of the side bearer. Indicator grooving is implemented on a working face and on a lateral wall of a carrying body, enabling visual control of a side bearer technical condition.

13 Claims, 2 Drawing Sheets

SIDE BEARERS IN A RAILCAR TRUCK

CROSS-REFERENCE TO RELATED APPLICATION

This application claims priority to Russian Patent Application No. 2014148119, filed Dec. 1, 2014 and titled "Round Side Bearing."

FIELD OF THE INVENTION

The present invention relates to the design parts of a railcar truck, more particularly, to the side bearers limiting reciprocal displacement of a truck and railcar under the frame.

BACKGROUND

Known railcar trucks consist of a carrying body with a bearing cup installed thereon by applying a springing element. The general concept is disclosed in U.S. Patent Application Publication No. 2004/0187726, filed Sep. 30, 2004 and titled "Ride Control Constant Contact Side Bearing Arrangement," now U.S. Pat. No. 7,121,212.

Disadvantages of the conventional design is the non-availability of fixing members between the carrying body and the bearing cup resulting in displacement of the bearing cup out of the carrier body of the bearer during operation or maintenance of a railcar. This can impair the performance of maintenance operations.

Conventional railcar side bearings consist of a carrying body with a base and a guiding opening wherein a bearing cup is installed by applying a springing element to its guide outer wall. This known concept is disclosed in RU 2370388, filed Jan. 27, 2009 and titled "Side Bearing Pad of Railway Car Trolley" (prior art).

Disadvantages of this prior art being the closest analogous solution of the claimed design with respect to a set of essential features is the non-availability of fixing members between the carrying body and the bearing cup resulting in accidental displacement of the bearing cup out of the carrier body of the bearer during operation or maintenance of a railcar. This can impair the performance of maintenance operations.

SUMMARY OF THE INVENTION

Technical result of the claimed invention is increased reliability of a railcar truck side bearer and improved performance of maintenance operations.

According to one embodiment, a side bearer of the railcar truck includes a carrying body with a base and guide opening, where a bearing cup is mounted by applying a springing element to its guide outer wall. The guide outer wall includes a thrust collar located with an open-end clearance in a groove of the guide opening on the side of the carrying body having a thrust face to ensure interaction with the thrust collar of the cup and limiting movement of the cup inside the guide opening with respect to the carrying body. The total clearance between the lateral face of the guide opening and the guide outer wall of the bearing cup does not exceed the total open-end clearance between the outer face of the thrust collar and the inner surface of the groove of the guide opening in the carrying body. Indicator grooving is implemented on a working face of the guide cup, wherein the depth of the grooving can be equal to a wear limit of the cup working face. The indicator grooving is implemented on the outer lateral surface of the carrying body wall at a distance from the carrying body face equal to a vertical wear limit of the cup working face. A guide stop is implemented on the inner face of the bearing cup to ensure proper location of the springing element, wherein the springing element is connected to the bearing cup by means of the fasteners, adhesive bond or rubber compound vulcanizing. The springing element is implemented as one or more compression springs. The bearing cup and the carrying body are made of ductile bainitic iron, wherein the bearing cup, guide opening of the carrying body and the thrust collar of the bearing cup are cylindrical. The thrust collar of the bearing cup is implemented as two or more thrust sectors. The guide opening from the side of the carrying body base is closed with a supporting plate, fixed at the base of the carrying body, wherein the supporting plate is equipped with the guide inner stops for locating of the springing element. The height of the bearing cup does not exceed the height of the carrying body.

The bearer of a railcar body disclosed herein differs from the prior art by the fact that the guide outer wall includes the thrust collar having an open-end clearance in the groove of the guide opening on the side of the carrying body base with a thrust face to ensure interaction with the thrust collar of the cup and limiting of the movement of the cup inside the guide opening with respect to the carrying body. Additionally, the total clearance between lateral face of the guide opening and the guide outer wall of the bearing cup does not exceed total open-end clearance between the outer face of the thrust collar and the inner surface of the groove of the guide opening in the carrying body. Also, the indicator grooving is implemented on a working face of the guide cup, wherein the depth of the indicator grooving can be equal to the wear limit of the cup working face. The indicator grooving can also be included on the outer lateral surface of the carrying body wall at a distance from the carrying body face equal to vertical wear limit of the cup working face. The guide stop is implemented on the inner face of the bearing cup to properly locate the springing element, wherein the springing element is connected to the bearing cup by means of the fasteners, adhesive bond or rubber compound vulcanizing. The springing element can be implemented as one or more compression springs. The bearing cup and the carrying body can be made of ductile bainitic iron. The bearing cup, guide opening of the carrying body and the thrust collar of the bearing cup can be cylindrical. The thrust collar of the bearing cup can be implemented as two or more thrust sectors. The guide opening from the side of the carrying body base is closed with a supporting plate, fixed at the base of the carrying body.

BRIEF DESCRIPTION OF THE DRAWINGS

Character of the invention is illustrated by means of drawings, where.

DETAILED DESCRIPTION

Figure 1:
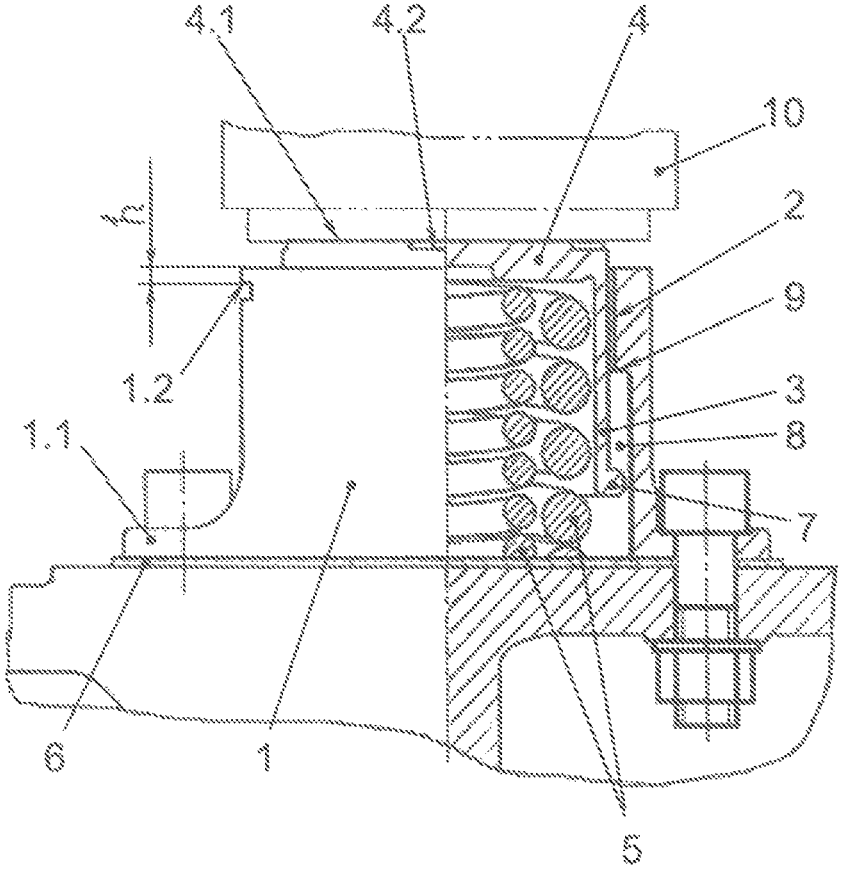
FIG. 1 is the general outline of a railcar truck side bearer with a part-sectioned view.
Figure 2:
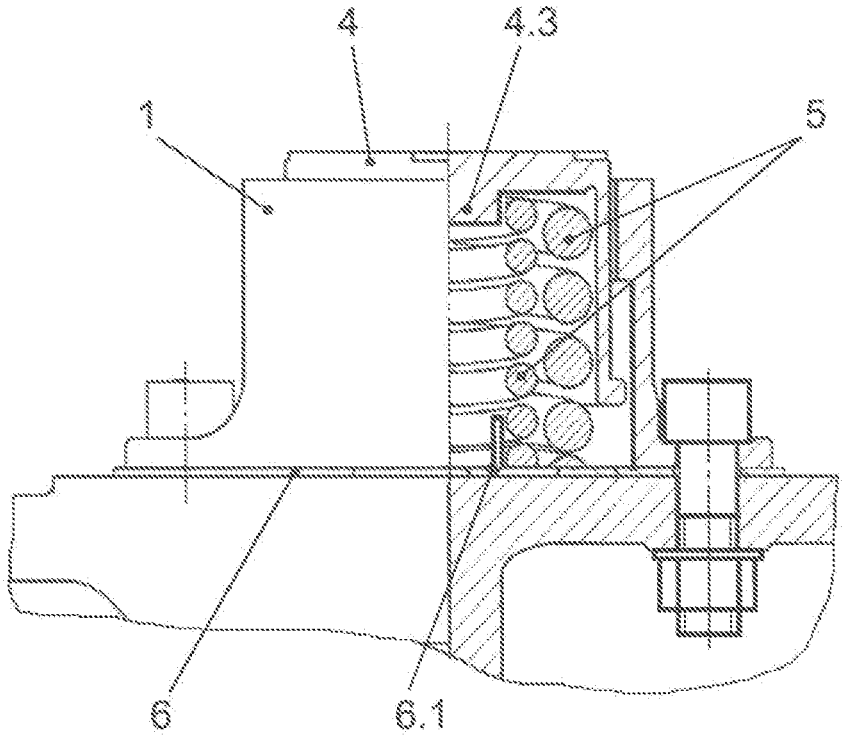
FIG. 2 is an embodiment of a side bearer.

A railcar truck side bearer includes carrying body 1 with a base 1.1 (FIG. 1). Carrying body 1 is implemented with a guiding opening 2, which is, typically, a parallel hole. A bearing cup 4 is mounted in a guiding opening 2 by applying a springing element to its guide outer wall 3. The bearing cup 4 and the carrying body 1 are made e.g. of ductile bainitic iron. The bearing cup 4 is spring loaded by means of a springing element 5, e.g., one or more compression springs located inside the bearing cup 4 and carrying body 1. For durability of the side bearer, the height of a bearing cup 4 should not exceed the height of a carrying body 1. The guide outer wall 3 of a bearing cup 4 includes a thrust collar 7, that can be presented by two or more thrust sectors, when required. A groove 8 with a limiting face 9 is included in the guiding opening 2 on the side of the base 1.1 of the carrying body 1. The limiting face 9 is designed to restrain displacement of the bearing cup 4 in the guiding opening 2 in relation to the carrying body 1. Fixing of the bearing cup 4 in an outer position, the cup being moved out of the carrying body 1, is performed by engaging the thrust collar 7 of the bearing cup 4 on the limiting face 9 of the groove 8, such engagement induced by the springing element 5. The thrust collar 7 of the bearing cup 4 is located with an open-end clearance in groove 8 of the guiding opening 2. Indicator grooving 4.2 can be implemented on a working bearing surface of the cup 4, the depth of the indicator grooving equaling to the wear limit of the cup working face 4.1. Indicator grooving 1.2 can also be implemented on the outer lateral surface of the wall of the carrying body 1 at the distance "h" from the upper wall face of the carrying body 1 equaling to the vertical wear limit of the wall face of the carrying body 1. The guide stop 4.3 can be implemented on the inner face of the bearing cup 4 (FIG. 2) to ensure proper locating of the upper ends of the springing elements 5 in the guiding opening 2. The springing elements 5 can be connected to the bearing cup 4 by means of fasteners, e.g., screws, washers (not shown), adhesive bond or rubber compound vulcanizing. The railcar truck side bearer can be equipped with a supporting plate 6 which closes the guiding opening 2 on the side of the base 1.1 and is attached to the base 1.1 of the carrying body 1. Use of the supporting plate 6 can prevent uncontrolled wear out of a bolster bearing surface, whereon the side bearer is installed, and can also allow assembly of the side bearer as an integral ready-use component assembly. Guiding stops 6.1 are implemented to ensure locating of lower end of the springing element 5 on supporting plate 6.

The railcar truck side bearer operates as follows, according to one embodiment.

By the action of springing elements 5, the cup working face 4.1 of the bearing cup 4 is pressed against the bearing surface of the car body side bracket 10. Upon movement along the railway, swaying motion of the car body is transferred to the cup working face 4.1 of the bearing cup 4 through the side bracket 10. Bearing cup 4 reciprocates inside the guiding opening 2 of the carrying body 1. In turn, the thrust collar 7 of the bearing 4 moves freely in the groove 8, and does not impede the reciprocating motion of the bearing cup 4 in the guiding opening 2. Should the load of the side bracket 10 be removed from cup working face 4.1 of the bearing cup 4 (e.g., upon a car repair, dismantling of a truck) the springing elements 5 expand, moving the bearing cup 4 along the guiding opening 2 until the thrust collar 7 touches the limiting face 9 of the groove 8, thus preventing displacement of the bearing cup 4 out of the body 1.

Due to the fact that total clearance between the lateral face of the guide opening 2 and the guide outer wall 3 of the bearing cup 4 does not exceed the total open-end clearance between the outer face of the thrust collar 7 and the inner surface of the groove 8, the lateral surface of the guiding opening 2 is the reference guiding surface for the outer wall 3 of the bearing cup 4. This can ensure a reliable skew-eliminating reciprocating spring-loaded motion of the bearing cup 4 inside the body 1.

Upon implementing the indicator grooving 4.2 on the cup working face 4.1 of the bearing cup 4 with depth, equaling to the wear limit of the cup working face 4.1, or upon implementing the indicator grooving 1.2 on the outer lateral surface of the carrying body wall 1 at the distance "h," equaling to the vertical wear limit of the body 1, visual inspection of indicated surfaces and performance capacity of the side bearer is performed. When the amount of wear is equal to the depth of indicator grooving 4.2 or distance "h," the bearing cup 4, carrying body 1 or the side bearer assembly should be changed.

Thus, the use of limiting elements in the design of a railcar truck side bearer presented by the thrust collar 7 on the guiding wall 3 of the bearing cup 4, as well as by the limiting face 9 in the grooving 8 of the guiding opening 2, ensures unreleasable connection of the carrying body 1 with the bearing cup 4 under different truck service conditions, which increases reliability of a truck side bearer and performance of maintenance operations.

What is claimed is:

1. A side bearer of a railcar truck comprising:

a carrying body with a base and a guide opening, where a bearing cup is mounted by applying a springing element to a guide outer wall of the bearing cup, wherein the guide outer wall includes a thrust collar having an open-end clearance in a groove of the guide opening on the inner side of the carrying body with a limiting face to ensure interaction with the thrust collar of the bearing cup and limiting upward movement of the bearing cup inside the guide opening.

2. The side bearer of claim 1, wherein a total clearance between a lateral face of the guide opening and the guide outer wall of the bearing cup does not exceed a total open-end clearance between an outer face of the thrust collar and an inner surface of the groove of the guide opening.

3. The side bearer of claim 1, wherein indicator grooving is implemented on a working face of the bearing cup, and wherein the depth of the indicator grooving is equal to a wear limit of the working face of the bearing cup.

4. The side bearer of claim 1, wherein indicator grooving is implemented on an outer lateral surface of the carrying body at a distance of a vertical wear limit of the carrying body from a carrying body wall face.

5. The side bearer of claim 1, wherein a guide stop is disposed on an inner face of the bearing cup, wherein the guide stop positions the springing element.

6. The side bearer of claim 1, wherein the springing element is connected to the bearing cup by at least one of a fastener, adhesive bond, and vulcanizing rubber compound.

7. The side bearer of claim 1, wherein the springing element includes at least one compression spring.

8. The side bearer of claim 1, wherein the bearing cup and the carrying body are made of ductile bainitic iron.

9. The side bearer of claim 1, wherein the bearing cup, guide opening of the carrying body and the thrust collar of the bearing cup are cylindrical.

10. The side bearer of claim 1, wherein the thrust collar of the bearing cup includes at least two thrust sectors.

11. The side bearer of claim 1, wherein the guide opening is closed with a supporting plate that is fixed at the base of the carrying body.

12. The side bearer of claim 11, wherein the supporting plate is equipped with guide inner stops that position the springing element.

13. The side bearer of claim 1, wherein a height of the bearing cup does not exceed a height of the carrying body.

* * * * *